US006328588B1

(12) United States Patent
Tsai et al.

(10) Patent No.: US 6,328,588 B1
(45) Date of Patent: Dec. 11, 2001

(54) CABLE CONNECTOR ASSEMBLY

(75) Inventors: Thomas R. L. Tsai; Su-Ping Chen, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/306,560

(22) Filed: May 6, 1999

(30) Foreign Application Priority Data

May 8, 1998 (TW) ..... 87207132

(51) Int. Cl.[7] ..... H01R 13/627

(52) U.S. Cl. ..... 439/352; 439/76.1; 439/610; 439/607

(58) Field of Search ..... 439/607, 609, 439/610, 76.1, 687, 696, 352, 353, 357, 358

(56) References Cited

U.S. PATENT DOCUMENTS 4,762,505 * 8/1988 Asick et al. ..... 439/353
5,197,901 * 3/1993 Hashiguchi ..... 439/352
5,505,637 * 4/1996 Kramer et al. ..... 439/610
5,797,771 * 8/1998 Garside ..... 439/610
5,836,774 * 11/1998 Tan et al. ..... 439/76.1

* cited by examiner

*Primary Examiner*—Tulsidas Patel
(74) *Attorney, Agent, or Firm*—Wei Te Chung

(57) ABSTRACT

A cable connector comprises a main body, a shielding shell surrounding the main body, and a cover unit covering the shielding shell. The shielding shell includes a top shell and a bottom shell attached together. The top and bottom shells form a number of seating holes. The cover unit includes a top portion and a bottom portion attached together. The top portion forms a first and a second side walls. The first side wall of the top portion forms a cutout and a protrusion. The bottom portion has a first and a second side walls on opposite sides. The first side wall of the bottom portion forms an upwardly extending flange for insertion into the cutout of the first side wall of the top portion, and an upwardly extending latching tab defining an opening for engaging the protrusion of the top portion. The top and bottom portions form a number of seating columns for insertion into corresponding seating holes.

1 Claim, 6 Drawing Sheets

CABLE CONNECTOR ASSEMBLY

BACKGROUND OF THE INVENTION

1. Field of the Invention

The present invention relates to a cable connector, and particularly to a cable connector having a cover unit including two similar portions attached together.

2. Description of Prior Art

A cable connector is used to mate with a complementary connector for transmitting signals between two electronic devices, such as between a computer and a printer. However, since the cable connector is positioned externally between devices, the cable connector may become loosened or damaged due to an external force exerted thereon.

Referring to FIGS. 5 and 6 of the attached drawings, a cover unit 9 of a cable connector comprises top and bottom portions 91, 92. The bottom portion 92 has a pair of parallel side walls (not labeled) with a protrusion 921 formed on each inner surface thereof. The top portion 91 defines a slot 911 for engaging with the protrusion 921 to form the cover unit 9. However, when an external force is exerted on one side wall of the cover unit 9, the protrusion 921 is easily disengaged from the slot 911 and the top portion separates from the bottom portion 92. Thus, the cable connector 9 is unreliable and easily damaged. Such a cable connector is disclosed in Taiwan Patent Application No. 81214651. Additionally, some prior arts taught to connect top and bottom portions of a cover unit of a cable connector by supersonic soldering, which increases production costs.

SUMMARY OF THE INVENTION

Accordingly, an object of the present invention is to provide a cable connector having a cover unit including a top and bottom portions securely attached together for withstanding an external force exerted on a side wall of the cover.

In the preferred embodiment of the present invention, a cable connector comprises a main body, a shielding shell surrounding the main body, and a cover unit covering the shielding shell. The shielding shell defines a plurality of seating holes. The cover unit includes a top portion and a bottom portion attached together. The top portion forms a first and a second side walls on opposite sides thereof, the first side wall of the top portion defines a cutout and a protrusion. The bottom portion forms a first and a second side walls. The first side wall of the bottom portion forms an upwardly extending flange for insertion into the cutout of the first side wall of the top portion, and an upwardly extending latching tab defining an opening for engaging the protrusion of the top portion. The top and bottom portions form a plurality of seating columns for insertion into corresponding seating holes.

BRIEF DESCRIPTION OF THE DRAWINGS

Other objects and advantages of the present invention will be understood from the following description of a cable connector in accordance with a preferred embodiment of the present invention shown in the accompanying drawings, in which.

DETAILED DESCRIPTION OF THE PREFERRED EMBODIMENT

Figure 1:
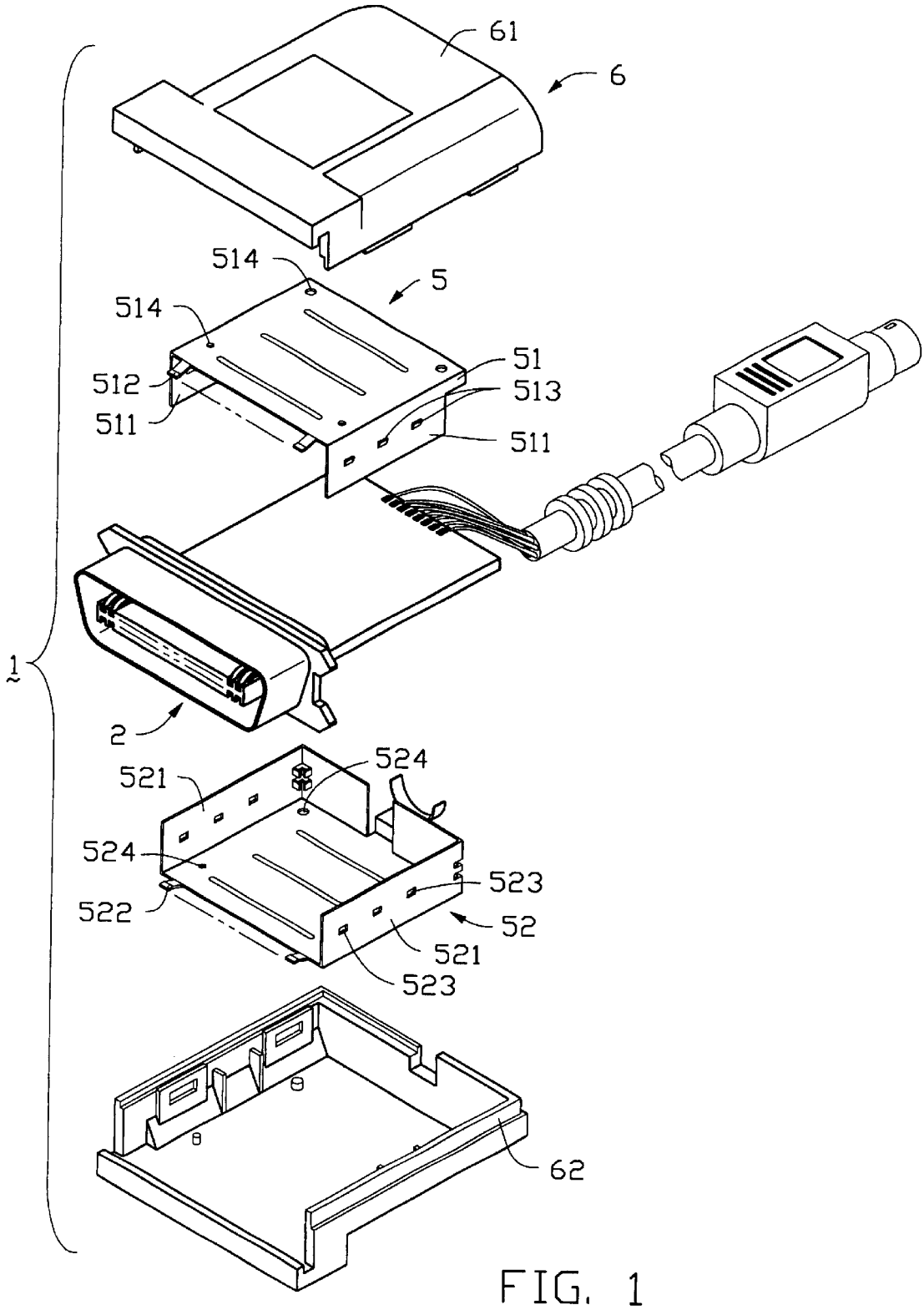
FIG. 1 is an exploded view of a cable connector embodying the concepts of the present invention.

Referring to FIG. 1, a cable connector 1 in accordance with the present invention comprises a main body 2, a shielding shell 5 and a cover unit 6. The shielding shell 5 comprises a top shell 51 and a bottom shell 52 attached together. The top and bottom shells 51, 52 form a pair of top and bottom tabs 511, 521 stamped from opposite side edges thereof, and a plurality of contact fingers 512, 522 extending from a front edge thereof for contacting the main body 2 to enhance shielding and grounding. Each top tab 511 forms a plurality of protrusions 513 on an outer surface thereof. Each bottom tab 521 forms a plurality of perforations 523 for engaging with the protrusions 513 to form the shielding shell 5. Additionally, the top and bottom shells 51, 52 define a plurality of seating holes 514, 524.

Figure 2:
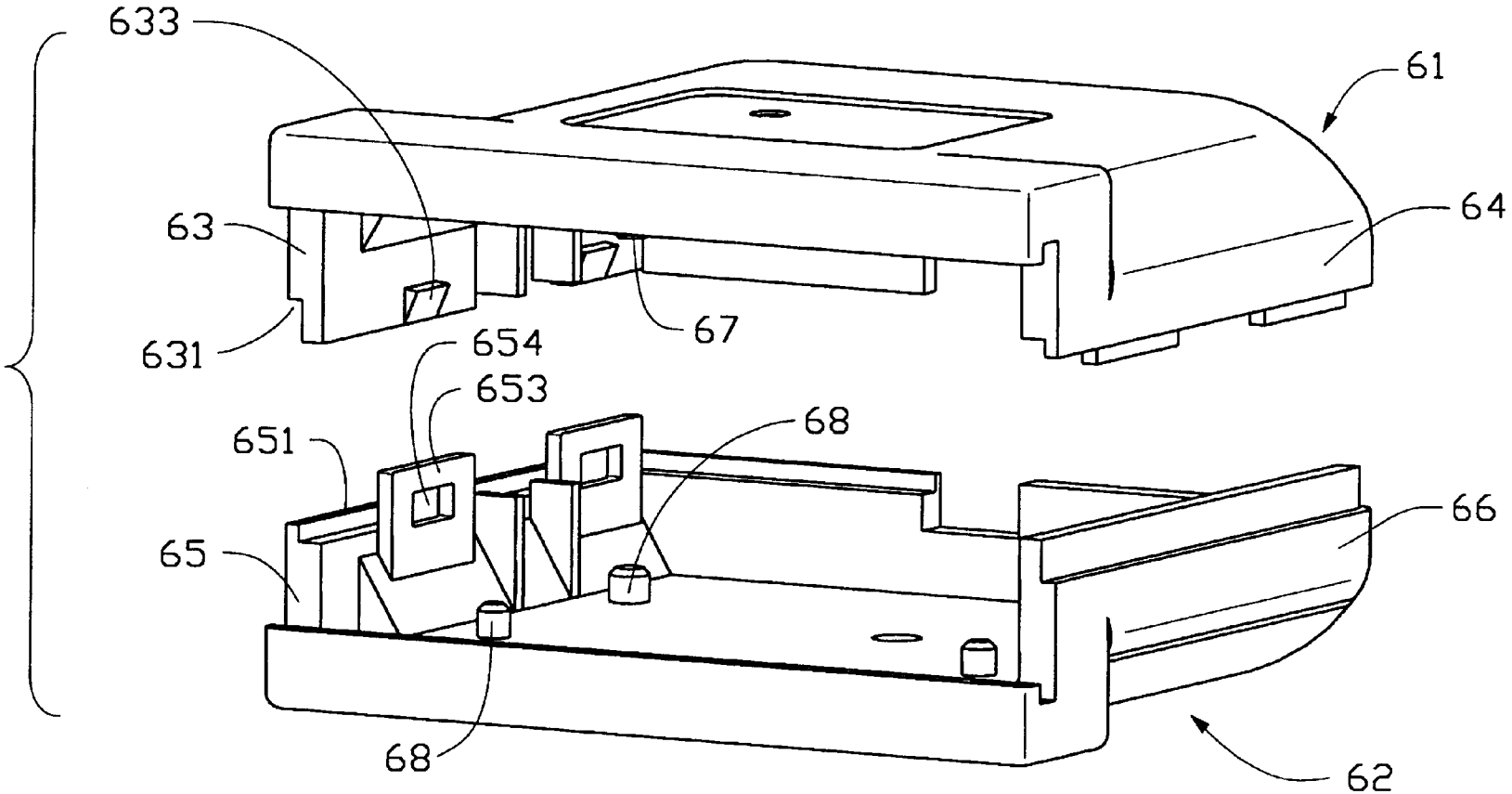
FIG. 2 is an exploded view of a cover unit of the present invention.

As seen in FIG. 2, the cover unit 6 includes a top and a bottom portions 61, 62 attached together. The top portion 61 forms a first and a second side walls 63, 64 on opposite sides thereof. The bottom portion 62 forms a first and a second side walls 65, 66 on opposite sides thereof for correspondingly engaging with the first and the second side walls 63, 64 of the top portion 61. Configuration of the first side wall 63 of the top portion 61 is similar to that of the second side wall 66 of the bottom portion 62. Configuration of the first side wall 65 of the bottom portion 62 is similar to that of the second side wall 64 of the top portion 61. The first side wall 63 of the top portion 61 forms a first cutout 631 in an outer surface thereof and a pair of protrusions 633 on an inner surface thereof. The first side wall 65 of the bottom portion 62 has a first flange 651 upwardly extending therefrom corresponding to the first cutout 631 of the first side wall 63. A pair of latching tabs 653 upwardly extend from the bottom portion 62 along an inner surface of the first side wall 65. Each tab 653 defines an opening 654 therein for fittingly receiving the corresponding protrusion 633. The top and bottom portions 61, 62 form a plurality of seating columns 67, 68 corresponding to the seating holes 514, 524 of the top and bottom shells 51, 52.

Figure 3:
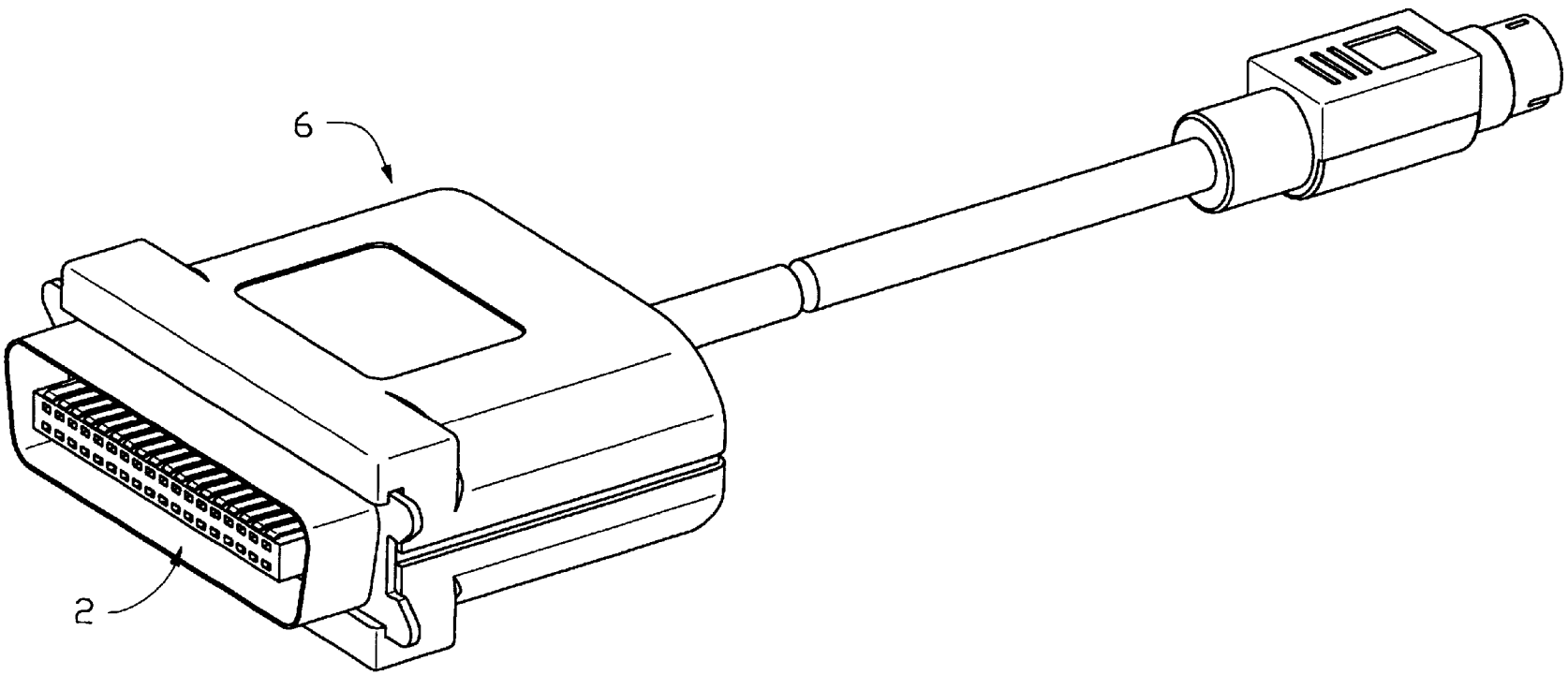
FIG. 3 is an assembled view of FIG. 1.
Figure 4:
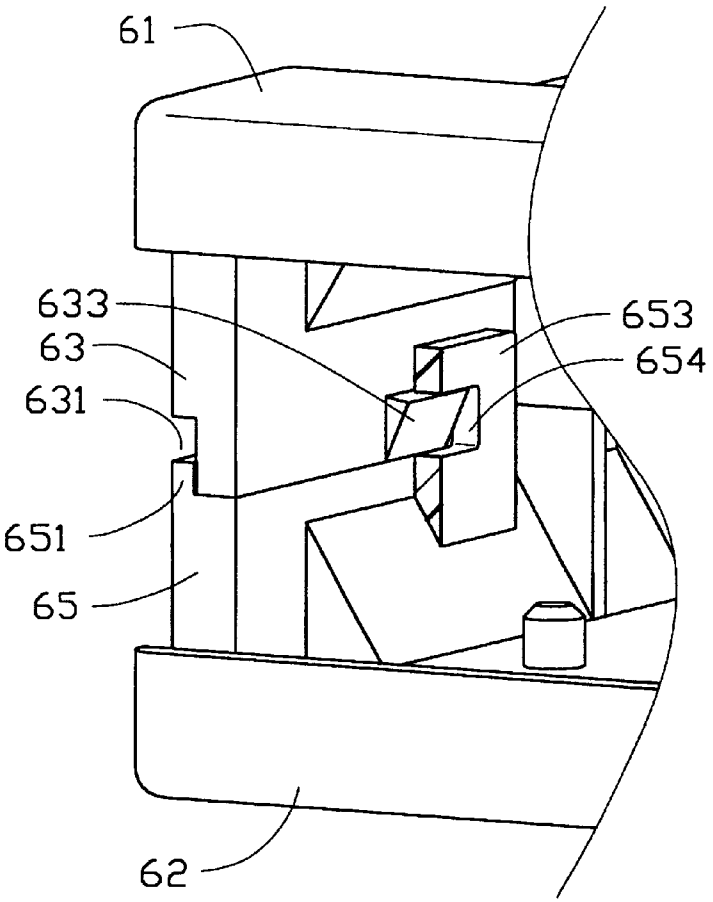
FIG. 4 is a partial, assembled view of FIG. 2, with a portion being cut away.
Figure 5:
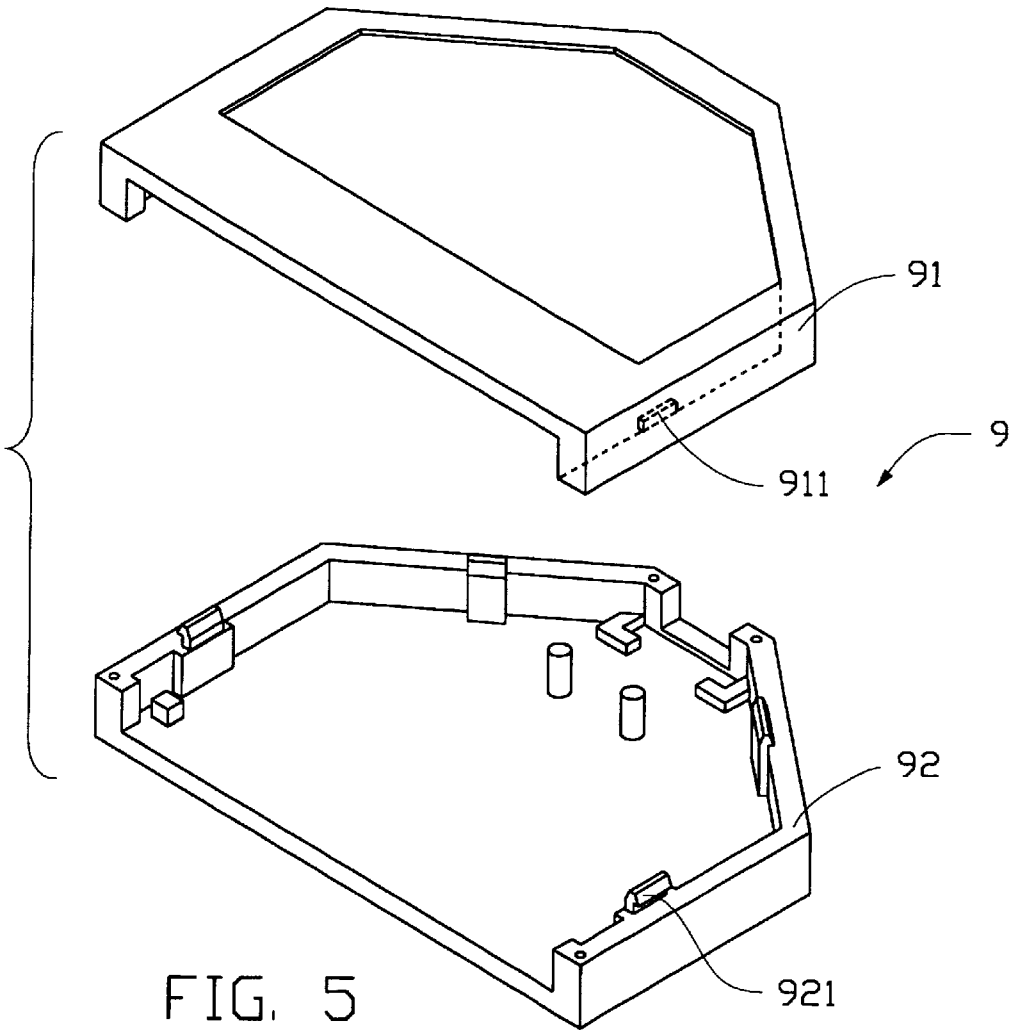
FIG. 5 (PRIOR ART)
FIG. 5 is an exploded view of a cover unit of a conventional cable connector.
Figure 6:
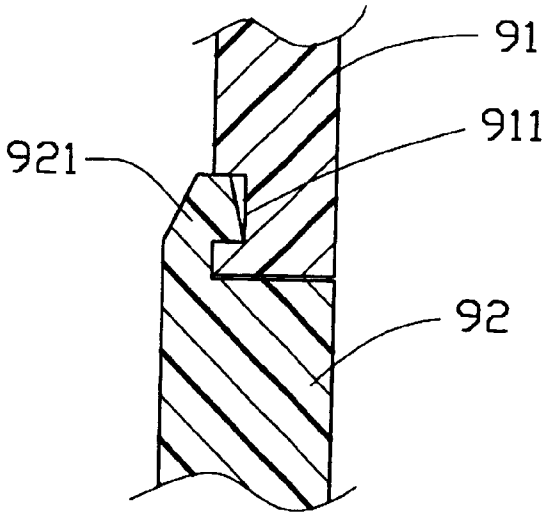
FIG. 6 (PRIOR ART)
FIG. 6 is a partial, cross-sectional, assembled view of FIG. 5.

Referring to FIGS. 3 and 4, in assembly, the shielding 5 surrounds the main body 2, then the cover 6 receives the shielding 5 with the main body 2 therein thereby forming the cable connector 1. The top portion 61 engages with the bottom portion 62 together to form the cover 6. At one side of the cover unit 6, the first flanges 651 of the first side wall 65 of the bottom portion 62 is inserted in the first cutouts 631 of the first side wall 63 of the top portion 61. The protrusions 633 of the first side wall 63 of the top portion 61 engage the openings 654 of the first side wall 65 of the bottom portion 62 to securely attach the top and bottom portions 61, 62 together. At the other side of the cover unit 6, engagement between the second side walls 64, 66 of the top and the bottom portions 61, 62 is the like. When an external force is exerted on one side wall of the cover unit 6, the top and bottom portions 61, 62 will not separate.

It will be understood that the present invention may be embodied in other specific forms without departing from the spirit of the central characteristics thereof. The present examples and embodiments, therefore, are to be considered in all respects as illustrative and not restrictive, and the invention is not to be limited to the details given herein.

We claim:

1. A cover unit for use with a cable connector assembly, comprising:

a top portion (61) including a first side wall (63) and a second side wall (64) opposite to each other, said first side wall (63) defining a cutout (631) in an outer face thereof and an inward protrusion (633) on an inner face opposite to said cutout (631) in a lateral direction; and a bottom portion (62) including a third side wall (65) and a fourth side wall (66) opposite to each other, said third side wall (65) defining a flange (651) on an outer face thereof and a latching tag (653) formed on an inner face thereof and oppositely spaced from said flange (651) along said lateral direction, said latching tag (653) defining therein an opening (654) extending therethrough in said lateral direction; wherein when assembled, the flange (651) is received within the cutout (631) and cooperates with the latching tag (653) to sandwich a bottom edge of the top portion (61) therebetween, under a condition that the protrusion (633) is latchably engaged within the opening (654).

* * * * *